United States Patent [19]

White

[11] 4,013,535

[45] Mar. 22, 1977

[54] ELECTROLYTE SEPARATOR TENSIONING DEVICE

[75] Inventor: Donald Elias White, Richfield, Ohio

[73] Assignee: The B. F. Goodrich Company, Akron, Ohio

[22] Filed: June 7, 1976

[21] Appl. No.: 693,373

[52] U.S. Cl. ..... 204/252; 204/98; 204/128; 204/258; 204/301

[51] Int. Cl.[2] ..... C25B 1/34; C25B 13/00; C25B 13/02; B01D 13/02

[58] Field of Search ..... 204/98, 128, 253, 254, 204/256, 258, 282, 301, 151, 252

[56] References Cited

UNITED STATES PATENTS

| | | | |
|---|---|---|---|
| 2,593,540 | 4/1952 | Cornwell et al. | 204/180 P |
| 3,296,111 | 1/1967 | Miller et al. | 204/151 X |
| 3,318,796 | 5/1967 | Brown et al. | 204/301 |

*Primary Examiner*—Arthur C. Prescott
*Attorney, Agent, or Firm*—Harry F. Pepper, Jr.; W. A. Shira, Jr.

[57] ABSTRACT

An electrolytic cell has an electrolyte separator to which is applied a controlled tension. Apparatus for applying tension to the separator includes a chamber for containing a pressurized fluid. The chamber has a movable boundary portion such as a piston or an elastomeric membrane. The boundary portion has an inward surface adapted to be disposed adjacent the fluid and an outward surface adjacent the separator. The fluid is maintained at a predetermined pressure which may be either constant or variable. The movable boundary portion may be in direct contact with the separator or may indirectly exert tension on the separator.

8 Claims, 2 Drawing Figures

ELECTROLYTE SEPARATOR TENSIONING DEVICE

BACKGROUND

This invention relates to electrolytic cells and more particularly to electrolyte separators.

Several types of electrolytic processes and cells are well known in many industrial branches of electrochemistry. "Diaphragm" type cells are often used in the electrolysis of aqueous solutions. This type of cell generally has anolyte and catholyte compartments which are separated by an electrolyte separator. Electrolyte separators prevent interaction of the anolyte and catholyte and separate the gaseous products evolving from each electrode. In the chloralkali industry, for example, cells having electrolyte separators are widely used in the electrolysis of sodium chloride brine to produce sodium hydroxide and chlorine gas.

Electrolyte separators may be rigid, such as porous sheets of plastic or ceramic. Rigid separators, when saturated with electrolyte, are usually electronically conductive while being nonselectively conductive to anions and cations. Separators may also be of the flexible permeable type, such as woven textiles or nonwoven fibrous mattes. Ion exchange membranes are one type of flexible separator. They are essentially permeable to electrolytes while being selectively conductive to either cations or anions.

Flexible separators such as ion exchange membranes have several advantages. These separators are not subject to fracture as are rigid separators. Furthermore, because they are generally thin, they are easy to fabricate and have minimal electrical resistance. As the cost of power to operate electrolyte cells increases, the need for these thin, flexible separators becomes more pronounced.

A major disadvantage of flexible separators is the swelling that usually occurs upon saturation of a separator with an electrolyte. The degree of swelling is dependent upon the concentration and the temperature of the electrolyte. This swelling creates slack in the separator.

Separator distortion is more likely to occur in a slackened separator. Most electrolytic cells employing separators have pressure differentials between the anolyte and the catholyte. Pressure differentials may be caused by density differences, hydrostatic head or kinetic head differences, etc., between the anolyte and catholyte. These forces can cause separator distortion in the form of buckling, weaving or folding. This is particularly true of cells having vertically extending separators. Distortion may lead to a number of malfuntions in the electrolytic cell.

Distortion sometimes is in the form of separator fluttering. This may cause the separator to fail by fatigue at its points of support. Distortion of the separator can block the rise of the product gases and can cause an uneven flow of electrolyte past the electrodes. The distortion may also cause the separator to come into direct contact with an electrode, thereby slowing the electrolysis process at such areas of contact and increasing the current density in other areas. Excessive current densities can result in high "$i^2r$" drops and overheating.

Presently, there are no adequate means for eliminating separator swelling in flexible separators. In an attempt to eliminate the aforementioned effects of separator swelling, methods of taking up the slack created by the swelling have been devised. For example, in some cells, the separator is stretched over a rigid frame and tension is applied by wedges inserted along one or more sides of the frame. As the separator swells, the wedges are manually pounded into the frame, thereby taking up the slack in the separator. This technique is sometimes used in metal winning cells with diaphragms of a permeable, woven cloth of man-made fiber. These diaphragms have sufficient rupture strength to withstand the high tension created by the manually inserted wedges.

This wedge tensioning method, however, is unsuitable for stretching relatively thin or weak separators, such as ion exchange membranes, which are used in other types of electrolytic cells. Ion exchange membranes, for example, have relatively low yield strengths which cannot be exceeded. A further problem with this method is that separator swelling varies under different conditions. For example, during a temporary shutdown, electrolyte may be drained from the cell and the separator may cool down, causing the separator to contract. The separator may then rupture if the wedges are not manually loosened to release the tension applied.

Another method proposed for eliminating separator distortion problems is supporting a separator between screens of nonconducting, foraminiferous, structurally strong material. However, screens can create problems by blocking the movement of electrolyte and product gas. They can also increase the distance required between electrodes, thereby causing a higher resistance to current flow.

Reinforcing the separator internally with fibers or woven textiles has also been suggested. This may decrease separator swelling but it does not completely eliminate the problem in cells with large separators. Furthermore, nonconductive fibers added to the separator create additional power losses because of the increased difficulty of ion migration.

SUMMARY OF THE INVENTION

It is an object of the present invention to alleviate separator distortion problems encountered with flexible separators.

It is a further object of the present invention to provide an electrolyte separator tensioning device which will maintain a predetermined tension in a separator without exceeding the yield strength of the separator.

These and other objects of the present invention which will become evident by the following detailed description are achieved in an electrolytic cell by a tensioning device which comprises a chamber for containing a pressurized fluid, the chamber having a movable boundary portion. The movable boundary portion has an inward surface adapted to be disposed adjacent the pressurized fluid, and an outward surface adjacent the separator. The tension device may also comprise means for maintaining the fluid at a predetermined pressure which may be constant or variable. The movable boundary portion may be in direct contact with the separator or may indirectly exert tension on the separator.

DETAILED DESCRIPTION OF A PRESENTLY PREFERRED EMBODIMENT

Figure 1:
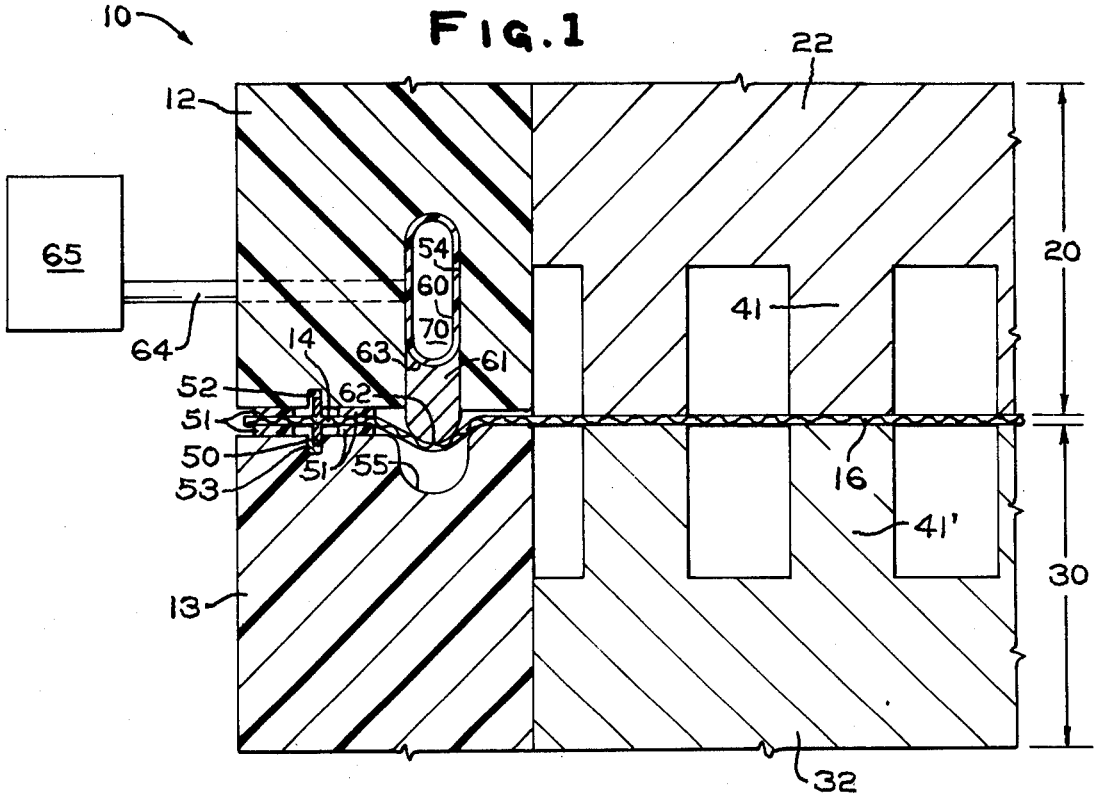
FIG. 1 is a top view of a portion of an electrolytic cell having an electrolyte separator tensioning device of the present invention.

FIG. 1 is a top view of a portion of an electrolytic cell 10 having vertically extending cell walls 12 and 13 which are sealed together by suitable means (not shown). The cell walls are of polyethylene but may be of any other suitable material well known in the art.

A vertically extending electrolyte separator 16 divides the cell into an anolyte compartment 20 and a catholyte compartment 30. The separator 16 in this embodiment is a rectangularly shaped ion exchange membrane which forms a selectively permeable boundary between the anolyte and the catholyte. Other types of separators, such as diaphragms, may be utilized in an appropriate cell.

An anode 22 is positioned in the anolyte compartment 20 adjacent the electrolyte separator 16. A cathode 32 is similarly positioned in the catholyte compartment 20. Each electrode 22 and 32 has a plurality of parallel, vertically extending and equally spaced lands or ridges 41. The ridges 41 are in contact with the separator 16 to give lateral support. The ridges are not clamped together so tightly as to significantly restrict taking up of separator slack by the device which will be described herein. It should, however, be noted that means, such as ridges 41, for giving lateral support to the separator are not a part of the apparatus of the present invention for taking up slack in the separator.

A vertically extending edge 14 of the rectangular separator 16 extends between cell walls 12 and 13. A portion of the edge 14 is firmly attached to a vertically extending clamp 50. The clamp 50 extends into vertically extending slots 52 and 53 in cell walls 12 and 13, respectively. The slots 52 and 53 brace the clamp 50 for firmly anchoring the separator 16. Vertically extending gaskets 51 are sealed against the cell walls 12 and 13 to prevent leakage of electrolyte. The edge 14 is firmly secured between the gaskets 51. Other edges of the separator 16, for example, an adjacent horizontally extending edge (not shown), can be similarly clamped and secured between other portions of the cell walls.

The cell wall 12 has a vertically extending groove 54 cut into the wall 12 normal to the separator 16. The groove 54 defines a portion of a boundary of a chamber 70 for containing a pressurized fluid. A similar vertically extending groove 55 is cut into the cell wall 13 normal to the separator 16 and directly opposite the groove 54. The groove 55 is slightly wider than the groove 54 but is only about one-third as deep.

Within the vertically extending groove 54 is an elongated, vertically extending bladder 60. The bladder 60 is in the form of a flexible elastomeric tube. The bladder 60 is adapted to be inflated or pressurized with any suitable fluid such as air, oil or water. Conduit 64 connects the bladder 60 to a means for maintaining the fluid at a predetermined pressure. In this embodiment, the means comprises a fluid reservoir 65. Other well known types of pressure regulators may be utilized in conjunction with or in lieu of such reservoirs to maintain the fluid at a predetermined pressure. Devices such as the reservoir, regulators, etc., have the ability to expand or contract the size of the chamber 70 while maintaining the fluid pressure constant. It is presently preferred to maintain the pressure of the fluid in the chamber 70 constant at all stages of cell operation.

The chamber 70 has a movable boundary portion which is formed by a vertically extending tension bar 61. The bar 61 is partially within the groove 54 in contact with the bladder 60. The bar has a vertically extending concave inward surface 63 contoured to the shape of the bladder 60. The bar 61 has a vertically extending outward surface 62 which is rounded. This outer surface 62 is in contact with the separator 16. A rounded outward surface permits a more unrestricted relative movement between the bar 61 and the separator 16 as the bar is pushed into groove 55. A roller may be attached to the outward surface 62 of the tension bar to eliminate sliding friction between the bar and the separator, the tension bar thereby indirectly exerting a tension on the separator.

It should be noted that the chamber 70 having a movable boundary portion, such as the tension bar 61, may be utilized without an elastomeric membrane, such as the bladder 60. For example, tension bar 61 could be designed as a piston in direct contact with the fluid and movable upon exertion of pressure by the fluid. However, due to machining tolerances, etc., it is presently preferred to utilize an impermeable elastomeric membrane such as a bladder. It should also be noted that the elastomeric membrane may be in the form of a diaphragm extending between the parallel sides of the groove 54. Furthermore, in some instances an elastomeric membrane such as a bladder or a diaphragm may be utilized without a rigid movable boundary portion such as the tension bar 61. In such a case, the elastomeric membrane itself can be considered the movable boundary portion of the chamber 70.

In preparing the cell 10 for operation, the separator 16 is clamped between the cell walls 12 and 13 as previously described. The bladder 60 is then inflated or pressurized to a predetermined pressure calculated to apply a tension to the separator 16 which is less than its rupture or yield strength. Expansion of the bladder will force the tension bar 61 against the separator. Before any electrolytes are added to the cell, the dry separator 16 is in its most contracted state. It can therefore more readily counteract the forces applied by the pressurized fluid.

An anolyte is then introduced and circulated in the anolyte compartment 20 while a catholyte is introduced and circulated on the other side of the separator 16 in the catholyte compartment 30. A current is applied across the cell, and the temperatures of the electrolytes are permitted to rise to the steady state value. The electrolytes will saturate the separate 16, ultimately causing it to expand or swell.

As the separator 16 expands, the internal tension of the separator will begin to decrease. However, a slight decrease in separator tension causes a drop in the force counteracting the pressurized fluid. The chamber 70 containing the fluid, due to the unbalanced forces, will then expand, pushing the tension bar 61 partially into the groove 55 of the cell wall 13. The tension bar 61 pushes the slack of the separator into the groove 55. As the slack due to expansion is taken up, the separator regains its predetermined tension, which supplys enough internal force to counteract a further expansion of the chamber 70.

During any temporary shutdown of the cell, the separator 16 will tend to contract or shrink, thereby causing a higher separator tension. This higher separator tension will counteract the constant pressure in the chamber 70. The tension bar 61 will thereby be forced back into the groove 54, allowing the slack which was gathered in groove 55 to be released. This releases the added tension on the separator which could have otherwise caused it to rupture.

In electrolytic cell 10, the tension device components are described as extending vertically along the cell wall portions 12 and 13. However, it may be desirable in some cells to take up slack in a horizontal direction, for example. It may be desirable to utilize a similar tensioning device at the top or bottom of the cell to provide a two-way stretch to the separator. This may be accomplished by using two interconnected chambers such as 70 along two adjacent edges of the cell wall. A single bladder may be extended in each of the chambers in the two desired directions. In an industrial plant utilizing several electrolytic cells, a single bladder may be extended between several cells, thereby simultaneously tensioning several separators with a single source of pressure.

Figure 2:
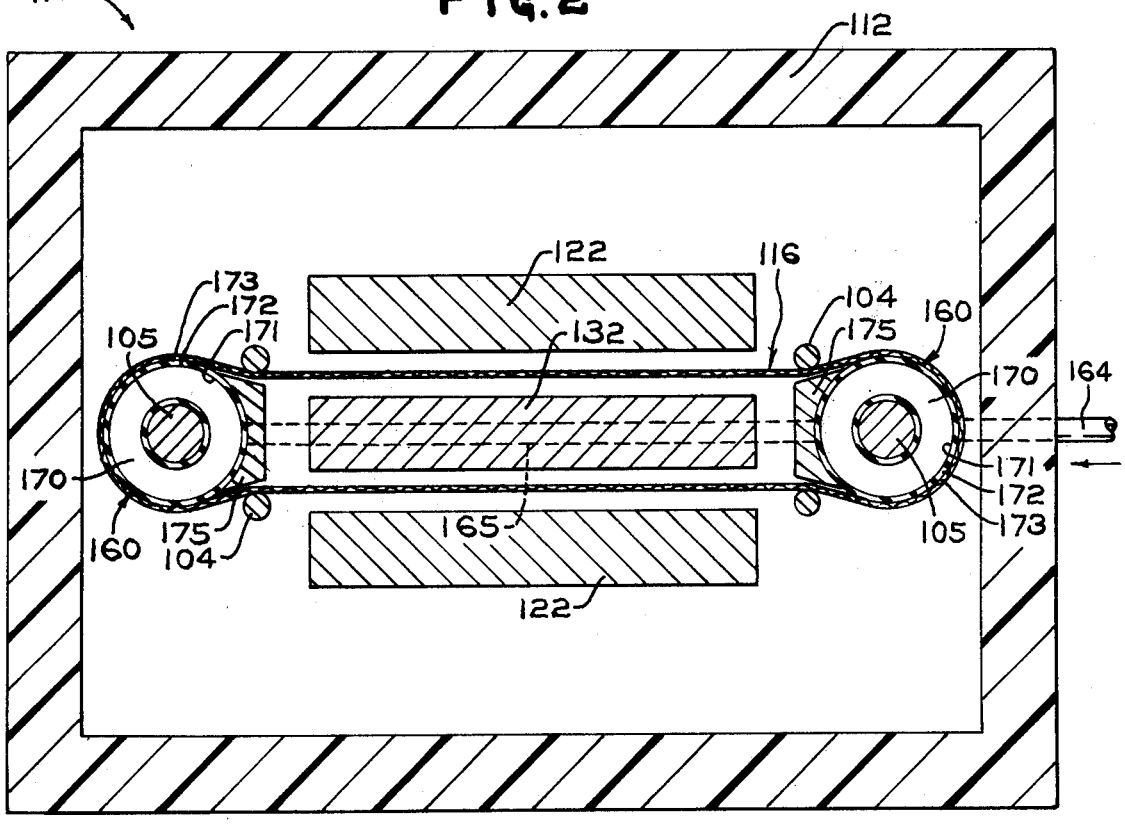
FIG. 2 is a top view of an electrolytic cell having an alternative embodiment of the separator tensioning device of the present invention.

FIG. 2 shows a top view of an alternative embodiment of the tensioning device of the present invention. A metal winning cell 110, for electrorefining of copper, for example, has cell wall portions 112 which form boundarys of the cell. Within the cell, a vertically extending cathode 132 is surrounded by an electrolyte separator in the form of a flexible diaphragm or "bag" 116. Outside of the diaphragm or "bag" and adjacent either side of the cathode 132 are vertically extending anodes 122. During the electrolysis process, fresh catholyte solution is fed into the diaphragm or "bag". Metal is dissolved off of the anodes and is deposited on the cathode.

The diaphragm 116 is maintained in a desired position by nonconductive diaphragm support posts 104. Rigid bladder support posts 105 extend vertically from the bottom of the cell. A vertically extending elastomeric membrane, in the form of a bladder 160, is secured around each post 105. The posts 105 thereby support the bladders 160 from within.

The bladders 160 each form a chamber 170 for containing a pressurized fluid. The chambers 170 have movable boundary portions 172. The movable boundary portions have an inward surface 171 which is in contact with the pressurized fluid, and an outward surface 173 which is in contact with the diaphragm 116. The chambers 170 also have boundary portions which are adapted to be supported by vertically extending, rigid backup supports 175. Each support 175 extends the length of its associated bladder 160 and provides support to portions of the bladder that are not in contact with the diaphragm 116. The supports 175 thereby direct all bladder expansion toward the diaphragm such that any bladder expansion transmits tension to the diaphragm 116. It should be noted that other means of support for portions of the bladder not in contact with the diaphragm, such as fabric reinforcement, may be used to prevent undesired bladder expansion in a cell similar to cell 110.

The bladders 160 are adapted to be inflated or pressurized to a predetermined pressure through conduit 164. Conduit 164 can be connected to a fluid reservoir (not shown) or any other regulated fluid source well known in the art. Conduit 165 extends between the bladders 160 to effect intercommunication therebetween and to equalize the pressure in each bladder 160.

The diaphragm 116 is wrapped around the posts 104 and the bladders 160 in a continuous loop. The length of the diaphragm 116 is such that it is almost taut when it is extended around the posts 104 and the bladders 160. As electrolyte is added to the cell and the temperature is raised, the diaphragm may begin to swell. When a predetermined pressure is applied to the bladders 160, the diameter of the movable boundary portion will increase, thereby taking up any slack in the diaphragm 160.

In either of the aforementioned cells, the tension applied to the separator should be constant and should be as high as possible without exceeding the separator yield strength. Therefore, during a shutdown of the cell in which the cell temperature drops or the separator dries off, the fluid pressure will usually not have to be varied because the yield strength of the separator will not drastically change. This eliminates some procedures such as loosening of wedges, that are necessary in previously used tensioning devices. However, as the separator ages, its yield strength may decrease. To compensate for this decreasing yield strength, the bladder pressure should be decreased at a rate proportional to the decline in yield strength. The predetermined pressure of the bladder may be programmed by any suitable method.

Some common applications for the separator tensioning device of the present invention include: electrowinning cells which employ permeable diaphragms of woven canvas, asbestos, or man-made fibers (e.g. for producing magnesium); electro-refining cells which employ permeable textile cloth as diaphragms (e.g. for producing nickel); electro-organic synthesis cells employing cation exchange membranes (e.g. for adiponitrile by redirection of acrylonitrile); inorganic synthesis cells which employ woven and unwoven textiles or asbestos as separators (e.g. chlor-alkali cells); and cells for inorganic synthesis which employ ion exchange membranes (e.g. electrodialysis cells).

Although the foregoing structures have been described for the purpose of illustrating presently preferred embodiments of the invention, it should be understood that many modifications or alterations may be made without departing from the spirit and scope of the invention as set forth in the appended claims.

I claim:

1. An electrolytic cell having an electrolyte separator and a separator tensioning device, said tensioning device comprising a chamber for containing a pressurized fluid, said chamber having a movable boundary portion, said movable boundary portion having an inward surface adapted to be disposed adjacent said pressurized fluid and an outward surface adjacent said separator, wherein movement of said movable boundary portion affects the tension of said separator.

2. A cell as defined in claim 1 further comprising means for maintaining said pressurized fluid at a predetermined pressure upon displacement of said movable boundary portion.

3. A cell as defined in claim 1 further comprising means for maintaining said pressurized fluid at a constant pressure upon displacement of said movable boundary portion.

4. A cell as defined in claim 1 further comprising an elastomeric membrane within said chamber, said membrane adapted to contain said fluid.

5. A cell as defined in claim 1 wherein said chamber is an elastomeric membrane.

6. A cell as defined in claim 1 wherein said boundary portion is an elastomeric membrane.

7. A cell as defined in claim 1 wherein said boundary portion is a tension bar.

8. A cell as defined in claim 1 further comprising a cell wall, wherein said chamber comprises a groove in said cell wall.

* * * * *